United States Patent [19]

Murray, Jr.

[11] 4,036,240

[45] July 19, 1977

[54] SMOKING APPARATUS WITH REPLACEABLE FILTERING CARTRIDGE

[76] Inventor: Joseph E. Murray, Jr., 27 Alpine St., No. 16, Malden, Mass. 02148

[21] Appl. No.: 533,244

[22] Filed: Dec. 16, 1974

[51] Int. Cl.[2] ..... A24F 1/30

[52] U.S. Cl. ..... 131/173

[58] Field of Search ..... 131/173, 212 A, 192

[56] References Cited

U.S. PATENT DOCUMENTS

| | | | |
|---|---|---|---|
| 1,229,943 | 6/1917 | Graham et al. | 131/173 |
| 1,513,147 | 10/1924 | Zahariadis | 131/173 |
| 1,579,703 | 4/1926 | Grant | 131/173 |
| 1,614,903 | 1/1927 | Shakal | 131/173 |
| 1,690,609 | 11/1928 | Zane | 131/173 |
| 2,660,179 | 11/1953 | Smith | 131/192 |
| 2,690,753 | 10/1954 | Jackson | 131/173 |
| 3,410,281 | 11/1968 | Ephron et al. | 131/173 |
| 3,420,242 | 1/1969 | Boukair | 131/173 X |

FOREIGN PATENT DOCUMENTS

| | | | |
|---|---|---|---|
| 1,409,942 | 7/1965 | France | 131/173 |
| 615,491 | 7/1935 | Germany | 131/173 |

*Primary Examiner*—Robert W. Michell
*Assistant Examiner*—V. Millin
*Attorney, Agent, or Firm*—Kenway & Jenney

[57] ABSTRACT

A smoking apparatus comprising a pipe bowl, a hollow pipe stem and a pipe body. The pipe body includes a detachable base portion and a replaceable filtering cartridge disposed within the body. The cartridge has a liquid therein for filtering, cooling and/or flavoring smoke passing therethrough. The cartridge further includes means for providing a first smoke port, a first tubular extension member extending therefrom, a means for providing a second smoke port, and a second tubular extension member extending therefrom. The first extension member extends below the top surface of the liquid when the apparatus is substantially upright and above that surface otherwise. The second extension member extends to a point which is always above the top surface of the liquid. The apparatus further comprises a connecting means for establishing a smoke path when the apparatus is upright, wherein the path passes from the bowl, through the first smoke port means, the first extension member, the liquid, the second extension member, the second smoke port means, and the pipe stem.

6 Claims, 5 Drawing Figures

SMOKING APPARATUS WITH REPLACEABLE FILTERING CARTRIDGE

BACKGROUND OF THE INVENTION

This invention relates to apparatus for smoking and more particularly, to pipes having a liquid filtering agent.

There are many types of pipes having a liquid filtering agent for the passage of smoke therethrough. However, all such pipes in the prior art are subject to one or more of the following disadvantages. Generally, the liquid-containing portion of such pipes must be periodically removed and cleaned in order to prevent a buildup of smoke condensate therein which might clog the smoke passageways in the pipe or affect the taste of the smoke in a manner reducing the smoker's satisfaction. In addition, the filtering agent must be replaced from time to time for similar reasons. In replacing the filtering agent, the pipe usually must be disassembled to a substantial degree, and one portion thereof must be filled to a level with a liquid filtering agent. In following this procedure, the smoker must exercise appropriate caution to prevent spillage of the filtering liquid. Furthermore, many pipes, even when reassembled and having the liquid filtering agent in its proper position, are quite sensitive to the orientation of the pipe regarding spillage of the liquid from its recepticle, entry of the liquid into the bowl of the pipe and tending to extinguish the embers therein, and/or entry of the liquid into the stem and the smoker's mouth. In addition, it is often quite inconvenient for the smoker to obtain a replacement liquid agent for prior art pipes.

It is an object of the present invention to provide a pipe having a liquid filtering agent in a replaceable filtering cartridge.

It is a further object to provide a pipe having a replaceable filtering cartridge which is readily inserted in the pipe with substantially little chance of spillage of the filtering agent disposed in the interior.

Another object is to provide a pipe having a replaceable filtering cartridge, including a liquid filtering agent, in which the cartridge is a spill-resistant container and adaptable for easy replacement in the pipe.

A still further object is to provide a pipe having a filtering cartridge which may be readily replaced in order to reduce the cleaning requirements of the pipe.

These and other objects of the invention will be apparent from the description following below, in conjunction with the figures in which.

SUMMARY OF THE INVENTION

According to the present invention, a pipe having a bowl, a hollow stem, and a body is provided with a base portion detachably connected to the body. The base portion includes a replaceable filtering cartridge disposed in its interior. Within the cartridge is a liquid filtering agent. The pipe includes connecting means which provide a smoke path from the bowl to the region inside the cartridge below the top surface level of the liquid agent, and via the region in the cartridge above the liquid agent, to the pipe stem. The base unit is detachably connected to the pipe body so that the filtering cartridge is readily accessible. The filtering cartridge includes a coupling means so that it may be readily removed from the assembly following detachment of the base unit. The cartridge further includes means providing smoke ports, and having tubular portions extending to its interior. The smoke port means are arranged so that when a predetermined amount of filtering agent is in the cartridge, substantially no fluid may escape to the ports regardless of the orientation of the cartridge.

As a further consequence of the replaceability of the filtering cartridge, the smoke passageway clogging and effect of taste of the smoke due to buildup of smoke condensate (within the filtering agent and the interior walls of its recepticle) associated with prior art pipes may be eliminated by the replacement of a used cartridge with a fresh one in lieu of a pipe cleaning procedure.

DESCRIPTION OF THE PREFERRED EMBODIMENT

Figure 1:
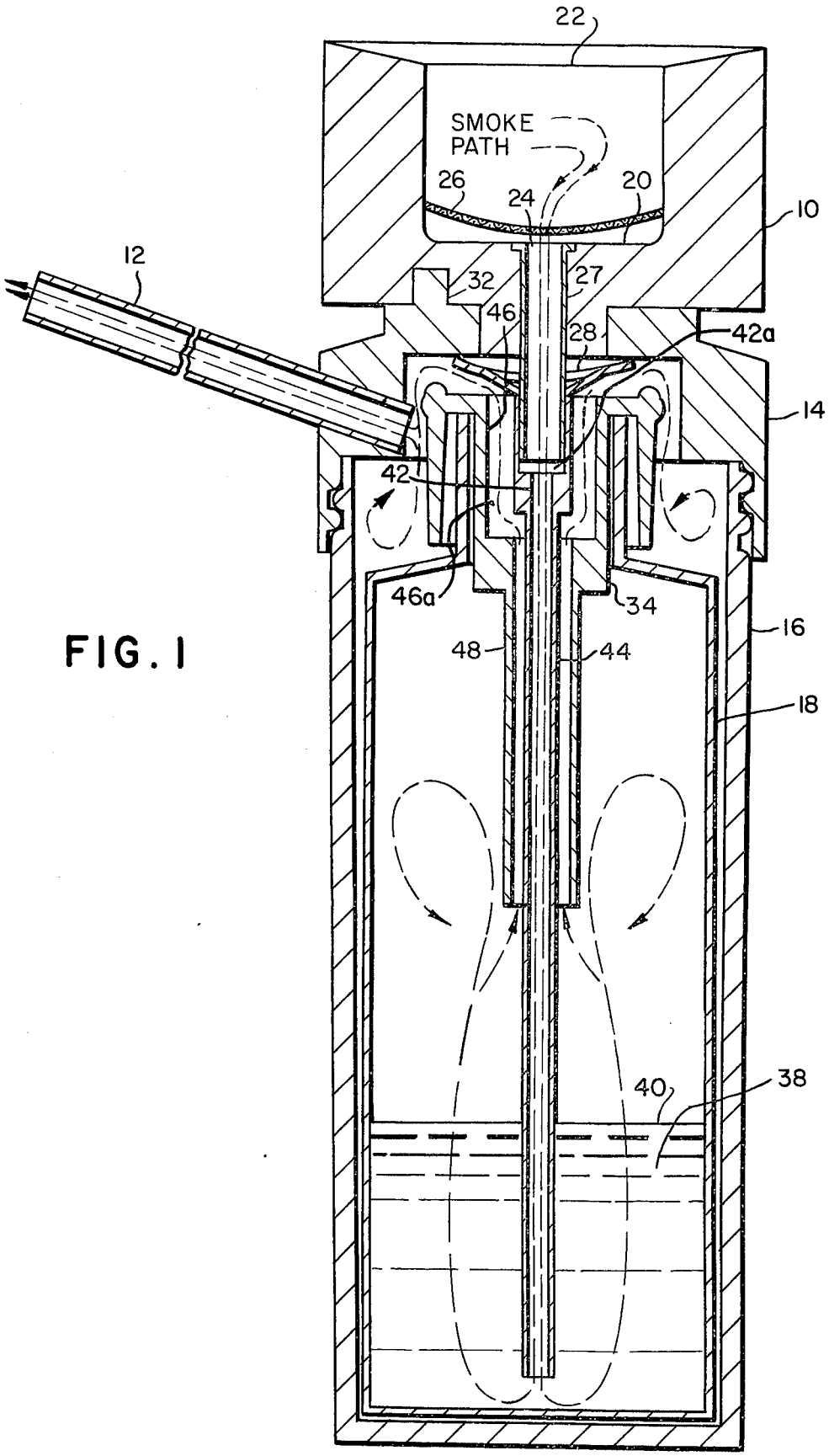
FIG. 1 shows a sectional view of an embodiment of the present invention.

FIG. 1 shows a sectional view of a smoking apparatus in accordance with the present invention. The illustrated embodiment includes a pipe bowl 10, and a hollow pipe stem 12 connected to a pipe body 14. Also connected to body 14 is a pipe base 16 which encloses a replaceable filtering cartridge 18. While the pipe bowl, body, base and cartridge of the illustrated embodiment are generally cylindrical, it will be understood that otherwise equivalent embodiments may have corresponding elements with non-circular (e.g. polygonal or elliptical) cross-sections. In the preferred embodiment, the pipe bowl 10 is made of briar and has sidewalls, bottom member 20, and includes an opening 22 at the top end and an opening 24 at the bottom end. The pipe bowl 10 further includes a screen 26 affixed to the sidewalls and extending across the interior region of bowl 10 to prevent the passage of smoking material through the opening 24.

The pipe body 14 has sidewalls with a generally cylindrical outer surface and further has an opening at each of the top and bottom ends thereof. The hollow pipe stem 12 is disposed with one end inserted in pipe body 14 so that the stem bore provides a smoke path between the region exterior to the sidewalls of body 14 and the region interior thereof.

The pipe bowl 10 is affixed to the pipe body 14 by means of a pipe bowl tube 27 which extends through the bottom opening 24 of bowl 10 and the opening at the top end of body 14. The bowl tube 27 has a rim portion at its end adjacent to opening 24 to prevent movement of tube 27 through opening 24. A push-on fastener 28, in conjunction with the rim portion of bowl tube 27 provide the coupling means for connecting bowl 10 to body 14. An anti-rotate peg 32 of body 14 is arranged to insert into a mating slot of bowl 10 to prevent bowl 10 from rotating with respect to body 14 when connected by the coupling means.

The pipe base 16 comprises generally cylindrical sidewalls and a base member. The base 16 has an opening at the top end thereof. A coupling means is provided by threaded portions on the top of base 16 and the bottom of body 14 so that the pipe base may be detachably connected to the pipe body 14. When so connected, the interior region of base 16 is joined with the interior region of pipe body 14 and, via the bore of stem 12, to the region outside pipe body 14.

A replaceable filtering cartridge 18 is disposed within pipe base 16. The cartridge 18 comprises generally cylindrical sidewalls, a base member and a top member 34 and contains a liquid filtering agent 38 having a top surface 40. In the preferred embodiment, the top member 34 is affixed to the sidewall portion of cartridge 18 by means of a method providing a permanent seal, e.g. by ultrasonic welding, or spin welding. In other embodiments, the top member may be detachably connected to cartridge 18.

The top member 34 includes first and second smoke port means 42 and 46, respectively, providing first and second smoke ports **42*a* and 46*a*, respectively. The first port means 42 is connected to a hollow, elongated bowl tube extension member 44 which extends to the interior portion of the cartridge 18 to a point below top surface 40 of the agent 38 with the cartridge 18 in an upright position. The second port means 46 is connected to a hollow, elongated exit tube member 48 which extends to the interior of cartridge 18 to a point above the top surface 40 of the liquid agent 38 with the cartridge 18 in an upright position. The volume of liquid agent 38 in cartridge 18 is predetermined so that the top level 40 is between the ends of extension members 44 and 48 when the cartridge is in an upright position and further, so that the level 40 is below the ends of members 44 and 48** when the cartridge is inverted beyond a horizontal position.

As a consequence of the construction of cartridge 18, the liquid containing cartridge provides a high immunity against leakage of the filtering agent through either of the ports **42*a* or 46*a* in any orientation of the cartridge 18**.

Figure 2:
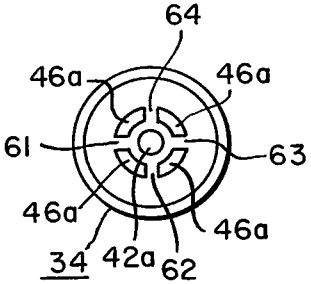
FIG. 2 shows a top view of the top member of the cartridge of FIG. 1.

It will be understood that the smoke port means 42 and its extension member 44 are connected to top member 34 in a manner (shown in FIGS. 1 and 2) whereby a smoke path from the interior of extension member 48 through smoke port means 46 is substantially unimpeded. For example, in the embodiment shown, supporting struts 61–64 for smoke port means 42 may extend radially from the walls of that port means to the outer walls of the port 46 so that the extension members 44 and 48 are coaxial and the smoke ports **42*a* and 46*a*** have coaxial circular and annular cross-sections, respectively. In that exemplary configuration, the smoke path passes between the supporting struts.

It will be further understood that in the present embodiment, member 34 of cooling cartridge 18 is constructed of a relatively resilient material, such as polyethylene and the bowl tube 27 is constructed of a relatively rigid material, such as stainless steel. The end of tube 27 which extends into the interior of pipe body 14 has an outer diameter sufficient to frictionally engage the inner surface of the first port means 42 of the cooling cartridge 18 in a manner establishing a substantially air-tight seal.

As a result of this construction, a smoke path (indicated in FIG. 1 by the broken lines) is established from bowl 10 to the outlet end of pipe stem 12. Between bowl 10 and stem 12, the smoke path passes through the bowl tube 27 and through port means 42 and the extension member 44 into the region 38 of cartridge 18. The smoke path continues to the region above the top level 40 and through the member 48 and the associated port means 46 into the region between cartridge 18 and the boundary formed by body 14 and base 16. As noted above, this region is joined by the bore of stem 12 to the exterior of the smoking apparatus.

Furthermore, the cartridge 18 may be readily interchanged in the pipe by simply unscrewing the base portion 16, pulling the old cartridge from bowl tube 27, press-fitting the new cartridge on bowl tube 27, and replacing the base 16. When stored outside the pipe, cartridge 18 may be fit with a cap portion on top member 34 to prevent evaporation of the fluid through the smoke port means; and 42 or 46.

It will be understood that the filtering agent 38 within the replaceable cartridge may take many forms in accordance with the present invention. For example, water may be used to provide a cooling agent for condensing tar and other components from the smoke. A menthol fluid might also be used as a filtering agent to provide the same filtering effect and additional cooling. Furthermore, such a filter agent would impart a menthol flavor to the smoke. Alternatively, other aromatic and flavored liquids may be used.

Figure 5:
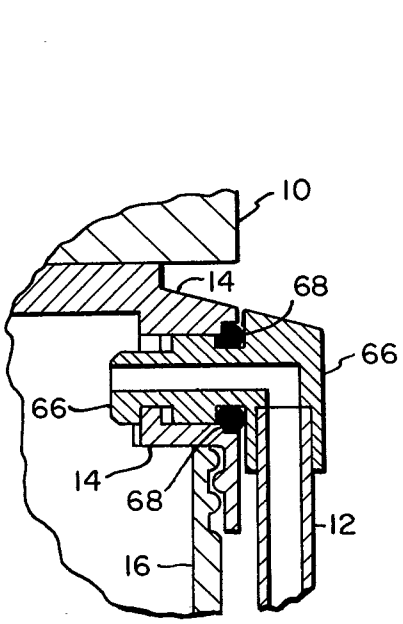
FIG. 5 shows a fragmentary sectional view of a portion of the embodiment of FIGS. 3 and 4.
Figure 4:
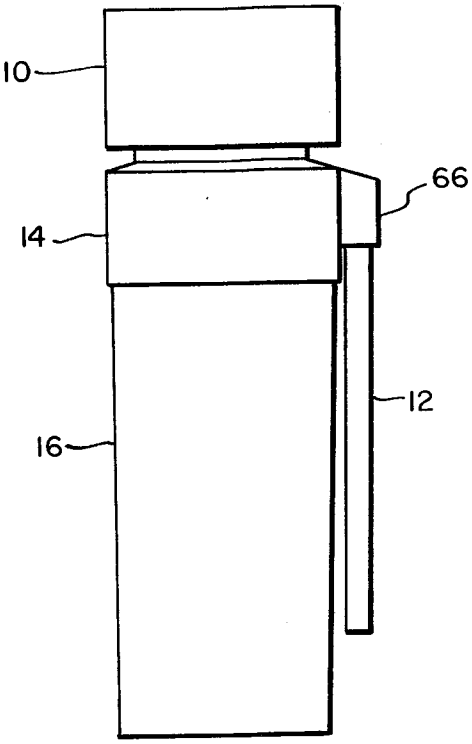
FIGS. 3 and 4 show side views of an alternative embodiment of the present invention.
Figure 3:
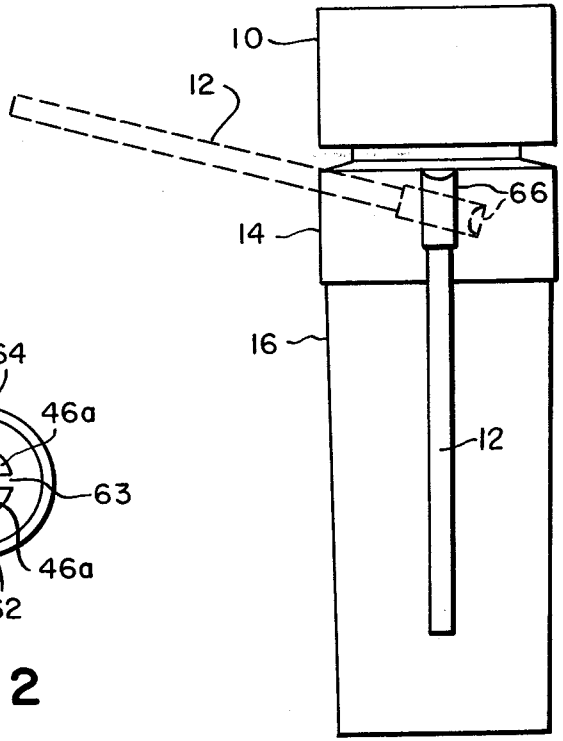

In other embodiments, the pipe stem 12 may be arranged with a hinged coupling to the body 14, so that stem 12 may be folded down when not in use. FIGS 3 and 4 show side views of such an embodiment with stem 12 being shown with a solid line for the folded down position and with a broken line for the unfolded position. FIG. 5 shows a sectional view of the hinge of the embodiment of FIGS. 3 and 4, showing a stem coupling member 66 and resilient ring 68. The elements of FIGS. 3–5 which correspond to elements in the embodiment of FIG. 1 are shown with identical reference numerals. It will be understood that the hinged configuration of FIGS. 3–5 is merely exemplary and that alternative configurations well known in the art may be used in keeping with the present invention.

The invention may be embodied in other specific forms without departing from the spirit or essential characteristics thereof. The present embodiments are therefore to be considered in all respects as illustrative and not restrictive, the scope on the invention being indicated by the appended claims rather than by the foregoing description, and all changes which come within the meaning and range of equivalency of the claims are therefore intended to be embraced therein.

I claim:

1. A smoking apparatus comprising:

A. a pipe bowl,

B. a hollow pipe stem,

C. a pipe body, said body including a detachable base portion and means for detachably connecting said portion to the remainder of said body and further including a replaceable filtering cartridge, disposed within said base portion, said cartridge having a top member and comprising:

1 a means for containing a predetermined volume of liquid filtering agent therein, 2 first smoke port means providing a first smoke port, 3 a first tubular extension member, attached to and extending from said first port means to a point interior to said cartridge, 4 second smoke port means providing a second smoke port, and 5 a second tubular extension member attached to and extending from said second port means to a point interior to said cartridge, and wherein said first tubular extension member is adapted to extend into said liquid filtering agent only when said cartridge is substantially upright, and to extend only to points located above the top surface of said liquid filtering agent otherwise, and wherein said second tubular extension member is adapted to extend only to points located above the top surface of said liquid filtering agent for all orientations of said cartridge, and wherein said first and second port means are integrally attached to said top member, and wherein further said first port means and first tubular extension member are substantially coaxial with and disposed within said second port means and second tubular extension member, said first and second port means being integrally attached by one or more radially extending struts, D. connecting means for interconnecting said bowl, stem and body to provide a smoke path when said smoking apparatus is upright from the lower interior portion of said bowl to the bore of said stem, said path between said bowl and stem sequentially including:

1. the interior regions of said first port means and said first tubular extension member,
2. the interior region of said cartridge below said top surface,
3. the interior region of said cartridge above said top surface,
4. the interior regions of said second tubular extension member and said second port means, and
5. the interior region of said body between said cartridge and said body.

2. The smoking apparatus according to claim 1 wherein the inner surface of said first port means is relatively resilient and wherein said connecting means comprises a relatively rigid, hollow bowl tube with one end affixed to said pipe bowl, and extending therefrom into said body, and with the other end having a predetermined outer diameter sufficient to frictionally engage said inner surface of said first port means forming a substantially airtight seal.

3. The apparatus according to claim 1 wherein said first and second smoke port means are adapted so that said first and second smoke ports are substantially concentric, said first smoke port having a substantially circular cross-section, and said second smoke port having a substantially annular cross-section.

4. The apparatus according to claim 1 wherein said connecting means includes hinged coupling means for pivotally connecting said stem to said body.

5. A smoking apparatus comprising, in combination:

A. a pipe body having one or more sidewalls and an opening at the top and bottom ends thereof, and further having an elongated, hollow stem extending from one of said sidewalls to provide a smoke path from the region interior of said sidewalls to the region exterior thereof, B. a pipe bowl having one or more sidewalls, a bottom member, an opening at the top end of said bowl and a hollow bowl tube extending from said bowl bottom member to provide a smoke path from the region interior of said bowl sidewalls via the interior region of said bowl tube to the end of said tube opposite from said bottom member, C. a bowl coupling means for connecting said pipe bowl to said pipe body whereby said bowl tube passes through said top opening of said body, D. a detachable pipe base having one or more sidewalls, a bottom member, and an opening at the top end of said base, E. a base coupling means for detachably connecting the top end of said pipe base to the bottom end of said pipe body whereby the region interior of said base sidewalls joins the region interior of said body sidewalls, and F. a replaceable filtering cartridge for containing a predetermined volume of a liquid filtering agent in a portion of its interior region, said cartridge being positioned within said pipe base and having one or more sidewalls, a bottom member, and a top member, wherein said cartridge top member includes:

1. an integrally attached, hollow, elongated bowl tube extension member, said bowl tube extension member extending from said cartridge top member to the region interior of said cartridge sidewalls,
2. a bowl tube coupling means for connecting said bowl tube to said bowl tube extension member to provide a smoke path from the interior region of said bowl tube via the interior region of said extension member to the region interior of said cartridge sidewalls,
3. an integrally attached, hollow, elongated exit tube member, said exit tube member extending from said cartridge top member to the region interior of said cartridge sidewalls to provide a smoke path from the region interior of said pipe base sidewalls to the region interior of said cartridge sidewalls, wherein said bowl tube extension member is adapted to extend into said liquid filtering agent only when said cartridge is substantially upright, and to extend only to points located above the top surface of said liquid filtering agent otherwise, and wherein said exit tube member is adapted to extend only to points located above the top surface of said liquid filtering agent for all orientations of said cartridge, and wherein said bowl tube and exit tube extension members are substantially coaxial, said exit tube extension member being disposed about said bowl tube extension member, and being attached to said bowl tube extension member by one or more radially extending struts.

6. The apparatus according to claim 5 wherein said pipe body further includes a hinged coupling means for pivotally connecting said stem to said sidewall.

* * * * *